United States Patent [19]

Renner et al.

[11] Patent Number: 4,687,514

[45] Date of Patent: Aug. 18, 1987

[54] PROCESS FOR THE RECOVERY OF NOBLE METALS FROM SOLUTIONS

[75] Inventors: Hermann Renner, Worms; Karlheinz Kleiss, Linsengericht; Rainer Schlodder, Rodenbach, all of Fed. Rep. of Germany

[73] Assignee: Degussa Aktiengesellschaft, Frankfurt am Main, Del.X

[21] Appl. No.: 502,726

[22] Filed: Jun. 9, 1983

[30] Foreign Application Priority Data

Jun. 24, 1982 [DE] Fed. Rep. of Germany ..... 3223501

[51] Int. Cl.[4] ..... C22B 11/04

[52] U.S. Cl. ..... 75/109; 75/121; 423/22

[58] Field of Search ..... 423/22, 42, 508–510; 75/121, 108, 109

[56] References Cited

FOREIGN PATENT DOCUMENTS 620782 5/1961 Canada ..... 423/508

2911193 8/1980 Fed. Rep. of Germany .

OTHER PUBLICATIONS

Ohachi, T. and Taniguchi, I., "Growth of $\alpha Ag_2S$ and $\alpha Ag_2Se$ Single Crystals in Solid/Vapour System", Journal of Crystal Growth 40 (1977), 109–117.

Sienko, Michell J. and Plane, Robert A., *Chemistry*, second Edition, McGraw-Hill (1961), pp. 525–526.

Cooper, W. Charles, *Tellurium*, Van Nostrand Reinhold Co., 1971, pp. 114 and 116.

*Primary Examiner*—Robert L. Stoll

*Attorney, Agent, or Firm*—Cushman, Darby & Cushman

[57] ABSTRACT

There is described a process for the recovery of noble metals from dilute aqueous or non-aqueous solution which contain salts of non-noble metals and/or difficulty volatile inorganic or organic compounds, which is generally usable, simple to carry out and supplies high yields of noble metals. There is added to the noble metal solution elemental tellurium or a reducible tellurium compound at a temperature of 100° to 250° C. and the precipitate formed worked up in known manner.

7 Claims, No Drawings

PROCESS FOR THE RECOVERY OF NOBLE METALS FROM SOLUTIONS

BACKGROUND OF THE INVENTION

The invention is directed to a process for the recovery of noble metals from dilute aqueous or non-aqueous solutions which contain salts of non-noble (base) metals and/or other difficultly volatile inorganic or organic compounds. Included in the recoverable noble metals are silver, gold, and the platinum group of metals, e.g. platinum, palladium, rhodium, ruthenium, and iridium.

In the chemical technology of the noble metals there accumulate in many areas aqueous and non-aqueous solutions from which the noble metal portion must be recovered with the maximum possible separation from additional ballast materials such as non-noble metal salts, neutral salts, or difficultly volatile organic compounds.

In many cases, such as in several hydrometallurgical processes for the recovery of noble metal from ores, their subsequent products or from re-cycling materials, the working up of such solutions is in the middle of the process of recovery of the noble metal. Furthermore, the wet chemical separation of noble metals (Pt, Pd, Rh, Ir, Ru, Os, Au, Ag) from each other and their separation from non-noble metals as well as the purification of noble metals leads to relatively greatly diluted waste solutions, such as mother liquors from precipitations and crystallizations or wash solutions. Their noble metal portion must be recovered because of its high value. Finally, numerous chemical processes which are carried out with the help of noble metals, e.g. in the form of catalysts, furnish noble metal waste solutions of various compositions. The profitability of such process almost always is dependent upon the ability to substantially recycle the noble metal employed.

Only in exceptional cases, above all if the solutions to be worked up are composed of only noble metal compounds and a solvent which does not boil too high does a simple or vacuum distillation lead to the isolation and sufficient concentration of the noble metal. In the presence of additional impurities, such as non-noble metal salts, neutral salts or orgnic, high boiling compounds, the introduction of the noble metal containing waste solutions into the smelting process of a noble metal melt can be a useful way of working up. All noble metals are taken up completely by the volatile lead melt, while all other components or their subsequent products in the waste gas pass over into the slag or into the sulfidic phase. The dissolved noble metals can be precipitated from aqueous solutions or solutions miscible with water by reduction to the elemental state and be supplied to know subsequent treatment procedures. This reduction can be carried out, and therewith the noble metal concentrates obtained, by means of electric current, by means of non-noble metals such as zinc, iron or aluminum, or by means of reducing compounds such as hydrozine or sodium boranate. These methods of reduction, however, have many defects, such as the frequently incomplete precipitation, the introduction of additional, waste water loading, metals and the co-reduction of copper which is present, usually in a considerable amount, the co-precipitation of hydroxides of non-noble metals, as well as the formation of inflammable hydrogen gas. Besides the reduction reactions as a rule cannot be carried out in organic solutions. For organic solutions there have been proposed special combustion and pyrolysis processes for liquid wastes from homogeneous catalytic processes of the oxo-process for conversion of the noble metals in the concentrate, which noble metals in part are present in very dilute form.

This process have the disadvantage that air poluution readily occurs and the phosphorus contained in most of these solutions remains in the ash and can lead to difficulties in working up the concentrate.

A process has become known from German AS No. 2,911,193 which is special for the recovery of rhodium from residues of the oxo process in which process the residue is reacted with sulfur or a compound splitting out sulfur. This process has the disadvantage that it cannot be used in aqueous solutions, the sulfur, moreover for the most part forms reaction products disturbing the working up and frequently they are taken up in such large amounts of organic solution that the further working up is hindered.

Therefore, it was the problem of the present invention to develop a process for the recovery of noble metals from dilute aqueous and non-aqueous solutions which contain salts of non-noble metals and/or other difficultly volatile inorganic or organic compounds in which the process is readily carried out, generally usable and should operate with high yields of noble metal, without leading to difficulty in working up of the concentrate and the other reaction products.

SUMMARY OF THE INVENTION

This problem has been solved according to the invention by precipitating the noble metal by adding elemental tellurium or reducible tellurium compounds to the solution at a temperature of 100° to 250° C. and working up the precipitate in known manner. The addition of elemental tellurium or reducible tellurium compounds advantageously is carried out at a temperature of 120° to 200° C., whereby with solutions having low boiling point organic solvents and with aqueous solution there is preferably employed closed pressure containers. Of course it is also possible to replace the low boiling solvent, e.g. by distillation, by a higher boiling solvent. Surprisingly elemental tellurium or reducible tellurium compounds, e.g. telluric acid or tellurium dioxide in contrast to the known process and in contrast to the known sulfur and selenium represent precipitation agents for noble metals from dilute solutions which are distinguished by high efficacy in regard to yields of the noble metal, by the general usability both in aqueous and in organic solutions, as well as by the excellent sharpness of separation between noble metals and non-metals, including copper.

The precipitates formed, which contain the noble metals in elemental form or in the form of tellurides can be worked up in known manner, e.g. through roasting processes or wet chemical processes. Thereby the tellurium or tellurium containing fraction recovered can always be added again into the precipitation process so that the tellurium consumption, apart from slight entrainment losses is very small. In this case the tellurium represents a regeneratable cementation agent. Tellurium has the further advantage that is is practically not taken up by the organic waste solutions, for example, from the oxo syntheses, so that the organic solvent freed from the noble metal in a given case can be burned without hesitation.

Selenium likewise can be employed for the recovery of noble metals from organic solutions but it possesses practically the same disadvantages as the known sulfur.

The process of the invention is useful both for aqueous noble metal solutions, which additionally can contain still further cations and anions, such as halides, e.g. chlorides, bromides, or fluorides, cyanide, sulfate, thiosulfate or phosphate, and for organic solvents which for example can include alcohols, e.g. methanol, ethanol, isopropanol, or butanol, aldehydes, e.g. acetaldehyde, formaldehyde, chlorinated hydrocarbons, e.g. methylene chloride, ethylene chloride, tetrachloroethylene, or phosphorus containing organic compounds, e.g. trioctyl phosphate, triphenylphosphine.

The amount of tellurium added depends, above all, on the noble metal content of the solutions. This can be ascertained by simple experiments.

Unless otherwise indicated, all parts and percentages are by weight.

The process can comprise, consist essentially of, or consist of the stated steps with the recited materials.

The following examples explain the process of the invention.

EXAMPLE 1

100 ml of sump from the oxo synthesis which contained 644 ppm of rhodium were mixed with 0.5 gram of tellurium in a 250 ml beaker and treated at 150° C. with stirring for 1 hour. The precipitate was filtered off and worked up in conventional manner to rhodium.

The filtrate contains only 1 ppm of rhodium. The yield of rhodium was more than 99 weight %.

The tellurium content in the filtrate was 35 ppm.

EXAMPLE 2

7.5 liters of sump from the oxo synthesis which contained 165 ppm of rhodium were treated in a 10 liter flask with 22.5 grams of tellurium and stirred for 3 hours at 150° C. The precipitate was filtered off and worked up in conventional manner to rhodium.

EXAMPLE 3

700 liters of sump from the oxo synthesis which contained 160 ppm of rhodium were mixed with 2.1 kg of tellurium in an 800 liter reaction container and treated with stirring for 3 hours at 150° C. The precipitate still contained 2 ppm of rhodium. The yield of rhodium was 98 weight %.

EXAMPLE 4

100 ml of sump from the oxo synthesis which contained 495 ppm of rhodium were mixed with 0.5 grams of tellurium in a beaker and treated with stirring for 1 hour at 200° C. The precipitate was filtered off and worked up in a conventional manner to rhodium.

The filtrate still contained 3 ppm of rhodium. The yield of rhodium was more than 99 weight %.

What is claimed is:

1. A process for the recovery of rhodium from a dilute organic solution thereof comprising precipitating the rhodium by adding elemental tellurium to the solution at a temperature of 120° to 200° C.

2. A process according to claim 1 wherein the organic solution is the rhodium containing residue of the oxo synthesis.

3. A process according to claim 2 including the step of removing the precipitate from the solution.

4. A process according to claim 2 wherein the organic solution contains 165 to 644 ppm of rhodium and 98 to over 99% of the rhodium present is precipitated.

5. A process according to claim 1, including the step of removing the precipitate from the solution.

6. A process according to claim 1 wherein the precipitation is carried out in the presence of a low boiling solvent in a closed pressure container.

7. A process according to claim 2 wherein the precipitation is carried out in the presence of a low boiling solvent in a closed pressure container.

* * * * *